US011833700B2

(12) United States Patent
Georgakis et al.

(10) Patent No.: US 11,833,700 B2
(45) Date of Patent: Dec. 5, 2023

(54) SHAVING SYSTEMS AND METHODS

(71) Applicant: Bic Violex Single Member S.A., Anoixi (GR)

(72) Inventors: Georgios Georgakis, Anoixi (GR); Spyridon Gratsias, Anoixi (GR)

(73) Assignee: BIC Violex Single Member S.A., Anoixi (GR)

( * ) Notice: Subject to any disclaimer, the term of this patent is extended or adjusted under 35 U.S.C. 154(b) by 0 days.

(21) Appl. No.: 17/997,385

(22) PCT Filed: Apr. 7, 2021

(86) PCT No.: PCT/EP2021/059014
§ 371 (c)(1),
(2) Date: Oct. 28, 2022

(87) PCT Pub. No.: WO2021/219333
PCT Pub. Date: Nov. 4, 2021

(65) Prior Publication Data

US 2023/0166421 A1 Jun. 1, 2023

Related U.S. Application Data

(60) Provisional application No. 63/017,700, filed on Apr. 30, 2020.

(51) Int. Cl.
*B26B 21/00* (2006.01)
*B26B 21/40* (2006.01)

(52) U.S. Cl.
CPC ..... *B26B 21/4056* (2013.01)

(58) Field of Classification Search
CPC ..... B26B 21/4056
USPC ..... 30/34.5
See application file for complete search history.

(56) References Cited

U.S. PATENT DOCUMENTS

| | | | | |
|---|---|---|---|---|
| 5,537,749 | A * | 7/1996 | Cacioppo | B26B 21/40 30/41.5 |
| 11,633,869 | B1 * | 4/2023 | Tammera | B26B 21/4012 30/32 |
| 2004/0098862 | A1 * | 5/2004 | Orloff | B26B 21/521 30/41.7 |
| 2017/0097758 | A1 * | 4/2017 | Bauer | H04L 67/04 |
| 2019/0191850 | A1 * | 6/2019 | Yoganandan | B26B 21/4056 |
| 2020/0122348 | A1 * | 4/2020 | Good | B26B 19/388 |
| 2020/0206963 | A1 * | 7/2020 | Aggelopoulou | B26B 21/526 |
| 2020/0316799 | A1 * | 10/2020 | Tsegenidis | B26B 21/4087 |

(Continued)

FOREIGN PATENT DOCUMENTS

| | | | |
|---|---|---|---|
| EP | 3513923 | A1 | 7/2019 |
| GB | 2529999 | A | 3/2016 |
| WO | 2017062326 | A1 | 4/2017 |

OTHER PUBLICATIONS

International Search Report and Written Opinion issued in International Application No. PCT/EP2021/059014 dated Jun. 16, 2021 (2 pages).

*Primary Examiner* — Omar Flores Sanchez
(74) *Attorney, Agent, or Firm* — Bookoff McAndrews, PLLC

(57) ABSTRACT

A shaving system, the system comprising a shaver including a shaver head, one or more sensors configured to detect a flow or sound of water or an orientation of the shaver and a processor configured to determine a duration and/or water usage during a shaving session and/or a rinsing session.

20 Claims, 2 Drawing Sheets

(56) References Cited

U.S. PATENT DOCUMENTS

| | | | | |
|---|---|---|---|---|
| 2021/0146560 | A1* | 5/2021 | Panagiotopoulou | B26B 19/40 |
| 2021/0192434 | A1* | 6/2021 | Brette | B26B 21/4087 |
| 2021/0299897 | A1* | 9/2021 | Komianos | B26B 21/4087 |
| 2022/0001558 | A1* | 1/2022 | Good | B26B 21/4087 |

* cited by examiner

SHAVING SYSTEMS AND METHODS

This application is a National Stage Application of International Application No. PCT/EP2021/059014, filed on Apr. 7, 2021, now published as WO 2021/219333 A1, which claims benefit from US Provisional U.S. 63/017,700, filed on 30 Apr. 2020, their contents being incorporated herein.

TECHNICAL FIELD

Various aspects of the present disclosure relate to methods and systems for measuring water usage for a shaving device. More particularly, the present disclosure describes embodiments of systems and methods for measuring and/or monitoring water flow and/or water usage for a shaving device. The present disclosure may apply to shaving using a manual shaver and may also apply to shaving using an electric shaver, for example, a wet electric shaver.

BACKGROUND

Rinsing of a shaver is usually carried out without specific care. However, the rinsing quality and/or rinsing duration used during shaving may have an impact on the performance of the shaver and/or on the user's skin. In particular, rinsing duration may also have an impact on water consumption. Furthermore, sustainability is a significant global concern, and in particular, water consumption and waste is a key environmental factor influencing climate change. In this regard, a faucet may be left running when the water is not being used to rinse the shaver. Leaving the faucet running when the shaver is not being rinsed may increase the water consumption during the shaving session.

The background description provided herein is for the purpose of generally presenting the context of the disclosure. Unless otherwise indicated herein, the materials described in this section are not prior art to the claims in this application and are not admitted to being prior art, or suggestions of the prior art, by inclusion in this section.

SUMMARY

Aspects of the disclosure include:

A shaving system, the system comprising: a shaver including a shaver head; one or more sensors configured to detect a flow of water or an orientation of the shaver; and a processor configured to determine a duration and/or water usage during a shaving session and/or a rinsing session.

A computer-implemented method of analyzing shaving, in particular a shaving session. The method comprises: receiving one or more signals from a microphone, the signals being indicative of water flowing, wherein the microphone is coupled to a shaver, or to a dock for the shaver; analyzing the one or more signals from the microphone to determine an amount of water used for a shaving session; receiving one or more signals from the microphone and/or an accelerometer that are indicative of water flowing over a portion of a shaver, wherein the accelerometer is coupled to the shaver; and analyzing the one or more signals from the microphone and/or the accelerometer to determine a duration and/or an amount of water used for rinsing during a shaving session. In examples, one or more signals from the accelerometer may be indicative of a rinsing session, e.g., by an approximately horizontal orientation of the shaver, and one or more signals from the microphone may be indicative of water flowing from a faucet or other water source. An approximate horizontal orientation may be +/−15 degrees in relation to an imaginary plane that is parallel to the ground. In circumstances, the approximate horizontal orientation may reach up to +/−30 degrees. In examples, a stroke sensor may be coupled to the shaver, and one or more signals from the stroke sensor, or a lack of signals from the stroke sensor, may be indicative of a rinsing session.

In examples, the system may further include an alarm configured to be activated if the signals from the microphone and/or accelerometer and/or stroke sensor are received during a predefined amount of time. The alarm may also be configured to be activated if e.g. the signals from microphone are being received but the signals from the accelerometer and/or stroke sensor are not being received during a predefined amount of time. In these cases, the method may further comprise the steps of providing an alarm and configured the alarm to be activated according to one or more of the signals received from the microphone and the signals from the accelerometer and/or stroke sensor, and predefining an amount of time for rinsing and activating the alarm based on the amount of rinsing. Activation of the alarm may thus indicate that the faucet has been left open without a real need. In examples, the alarm may be a notification from a mobile device, e.g. a smartphone or any other intelligent device.

BRIEF DESCRIPTION OF THE DRAWINGS

The accompanying drawings, which are incorporated in and constitute a part of this specification, illustrate various exemplary embodiments and together with the description, serve to explain the principles of the disclosure. There are many aspects and embodiments described herein. Those of ordinary skill in the art will readily recognize that the features of a particular aspect or embodiment may be used in conjunction with the features of any or all of the other aspects or embodiments described in this disclosure. Embodiments of the present disclosure will now be described, by way of example only, with reference to the accompanying drawings in which.

DETAILED DESCRIPTION

Figure 1:
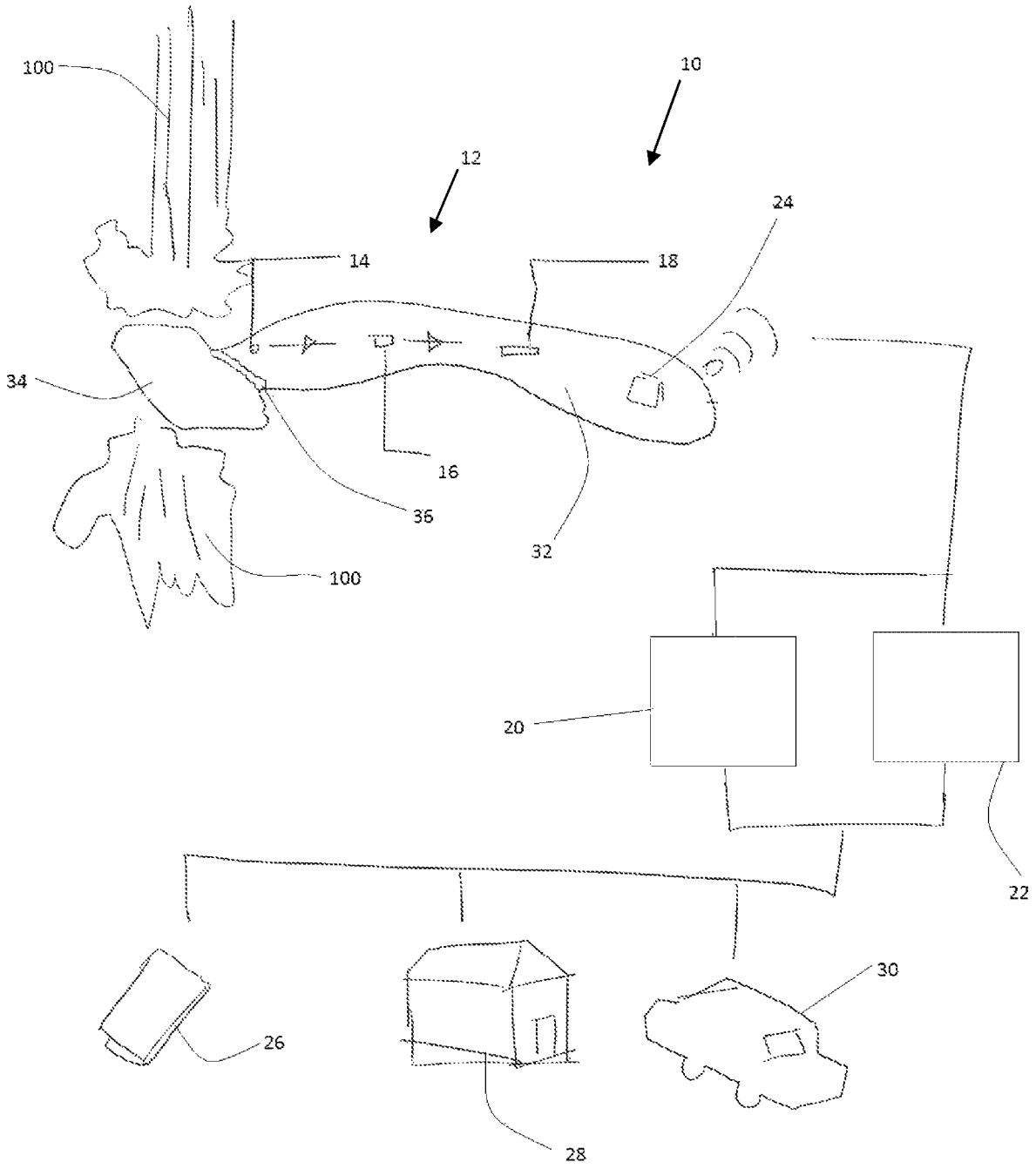
FIG. 1 illustrates a shaving system according to one aspect of the present disclosure.

The present disclosure relates to methods and shaving systems for monitoring and/or measuring the water consumption during a shaving session, particularly for monitoring and/or measuring the amount water used to rinse a shaver and/or shaver blades.

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges means the value, limit, and/or range +/−10%.

Embodiments of the present disclosure relate to monitoring and/or measuring the rinsing quality, rinsing duration, and/or total water usage during a shaving session in order to improve the quality, duration, durability, etc., of the shaving session, while also helping to reduce the total amount of water used during the shaving session. In particular, embodiments of the disclosure may provide a value or index of water consumption. A total water consumption during shaving may be approximately 4 to 6 lt., more specifically 5 lt. and a total water consumption during rinsing may be approximately 1 to 3 lt., more specifically 1.5 lt. At the same time, an indication of water rinsing requirements for different shaver head types may be provided. In some embodiments, a precise value of water consumption and detailed visualization of the consumption, e.g. via a mobile application/user interface may be provided.

In embodiments, a shaving system includes one or more sensors e.g., audio, pressure, and/or water flow, among others that may be coupled to a shaving razor (i.e., a shaver), and may monitor various aspects of a shaving session, including, e.g., water flow rate and a volume of water consumed, e.g. in mL or other quantities. The sensors may be in communication with a processor that may include one or more computer logics. The processor may then determine when water is flowing, for example, from a faucet, etc. The processor may also determine when water is flowing on, over, or through one or more portions of the shaver, for example, on, over, or through the shaver head. Water flowing through the shaver head may be indicating rinsing of the shaver. The shaving system and methods discussed herein may help a user minimize water consumption while also improving a lifetime and/or cleanliness of the shaver head by helping the user ensure the shaver head is properly rinsed.

In examples, the system may comprise an alarm that may be programmed to be activated e.g. when signals are received by the microphone and are not received by the accelerometer and/or stroke sensor during a predefined period of time. This may indicate, for example, that the water faucet has been left open while shaving i.e., when water from the faucet is not needed.

In addition to being presented to the user, collected and/or calculated shaving, rinsing, and water usage data may be used by the manufacturer in order to correlate the data with the use of various shavers and propose to the user an optimum shaver type for optimum rinsing performance and/or reduced water consumption.

Systems of this disclosure may be configured to collect and to process data relating to the shaver rinsing, and to provide to the user with information in order to improve the rinsing operation. For example, adjusting one or more of water flow, water temperature, rinsing frequency, rinsing duration to more optimum values during shaving may lead to reduced water consumption and/or improved shaving performance/skin care, e.g., less irritation, nicks, cuts, better fluidity and shaving comfort, better efficiency. For example, less water or warmer water, as in general warmer water may accelerate the rinsing of shaving debris, may be sufficient in order to remove a same predetermined amount of foam/skin/hair debris located between the blades of the shaver, leading thus to a reduction of the water consumption. Cleaner blades may improve shaving performance/skin care. Cleaner blades may also extend lifetime/durability of the shaver head.

Systems of this disclosure may include an algorithm programmed in the processor. The algorithm may collect data from various sensors e.g., accelerometers, stroke sensors, microphone, etc . . . , via the processor and provide accuracy metrics of the water flow estimation and assessment of the solutions to be offered to the user. In examples, the algorithm may be "trained" during the use of the system and hence gradually become accustomed to the user's individual shaving style and needs. Thus, the system may propose to the user more personalized advice on shaving razor and/or head choice, shaving techniques leading to improvements in water consumption, among others.

While a shaver head associated with a shaving razor is detailed herein, the disclosed techniques may be similarly applicable to other components of a shaving razor, or to other shaving products and devices. In other words, the exemplary embodiments herein may not be limited to application with a shaver head or cartridge with razor blades, but may also be implemented with other components, devices, machines, systems, or in any other similar context in which the contemplated embodiments may be applicable.

FIG. 1 illustrates a shaving system 10 for assisting shaving. System 10 includes a shaver 12 and one or more sensors coupled to, in communication with, and/or incorporated within shaver 12. For example, system 10 may include a sound sensor, for example, a microphone 14. System 10 may include an orientation sensor, for example, a gyroscope and/or an accelerometer 16. As discussed below, system 10 may also include one or more other sensors, including for example, a temperature sensor or thermocouple. System 10 may also include a processor 18, which may include one or more computer logics, for example, a first computer logic 20 and a second computer logic 22. Moreover, system 10 may include one or more communication units 24, which may be in communication and/or configured to communicate e.g. send and/or receive signals or information with one or more of a mobile device 26, a smart home system 28, a smart automobile 30, a computer, a tablet, a voice-activated in-home smart device, or one or more other user interfaces or components associated with a home or a user. Although not shown, system 10 may include one or more displays, for example, on shaver 12 or on a shaver mount or docketing station (not shown) with which shaver 12 may be docked and operatively connected to, for example, next to a sink, on a mirror, or otherwise in a bathroom or place where a user may shave. In examples, the microphone or a further microphone may be located in the shaver mount or docking station/base.

Shaver 12 includes a handle 32 configured to be held by a user and a shaver head 34. Handle 32 may include any suitable configuration to promote comfortable gripping by a user. For example, handle 32 may include coatings or coverings such as a rubber covering, or may contain geometric gripping features to prevent handle 32 from slipping within a hand of the user especially when handle 32 may be wet. Shaver head 34 includes one or more blades (not shown). Shaver head 34 may be a disposable and/or replaceable cartridge, or shaver head 34 may be an electric shaver head. Handle 32 may also include a handle attachment interface 36 at one end, e.g. the shaving/cartridge end of handle 32. Handle attachment interface 36 may be configured to selectively attach and/or release shaver head 34 to/from handle 32. As mentioned above, shaver 12 may be a manual shaver or an electric shaver. In aspects, handle attachment interface 36 may couple handle 32 and shaver head 34 through any mechanism known for attaching and releasing a disposable cartridge with a handle and/or for attaching and releasing an electric shaver head to an electric shaver handle. Shaver head may be pivotally attached to the handle.

As shown in FIG. 1, shaver 12 may be rinsed, for example, with water 100 from a faucet, other water source, etc. One or more sensors of system 10, for example, microphone 14 and/or accelerometer 16, may be configured to detect when water 100 is being delivered from the faucet, other water source, etc. In aspects, one or more sensors e.g. microphone 14, may detect the sound from water 100 being delivered from the faucet, other water source, etc. In aspects, the one or more sensors, e.g. microphone 14, may detect and be configured to distinguish when water 100 is delivered from the faucet or other water source, while not simultaneously being delivered to shaver 12, e.g. for rinsing shaver 12.

In examples, one or more sensors of system 10, for example, microphone 14 and/or accelerometer 16, may be configured to detect when water 100 is being delivered to rinse shaver 12. In aspects, one or more sensors, e.g., microphone 14, may detect the sound from running water 100, as discussed above. For example, microphone 14 may detect a louder or different sound, or other different details from water 100 that are indicative of water 100 passing on, over, or through shaver head 34, as compared to different sounds or different intensities of the sound that occur when water 100 is running while not passing on, over, or through shaver head 34. In examples, although not shown, system 10 may include another sensor, for example, another microphone, a pressure sensor, a water flow sensor, etc., on or proximate to shaver head 34, that is configured to detect water 100 passing on, over, or through shaver head 34. Furthermore, one or more sensors, e.g., accelerometer 16, may detect a position and/or orientation of shaver 12 that is indicative of rinsing shaver 12, for example, an orientation that is substantially horizontal. A substantially horizontal orientation may be +/−15 degrees in relation to an imaginary plane that is parallel to the ground. In circumstances the substantially horizontal orientation may reach up to +/−30 degrees. In examples, although not shown, system 10 may include a stroke sensor on or otherwise coupled to shaver 12. For example, the stroke sensor may be in communication with processor 18, and the stroke sensor may be configured to detect one or more shaving strokes, a temporal duration of one or more shaving strokes, a distance of the one or more shaving strokes, etc. In other words, processor 18 and/or the stroke sensor may include an algorithm that, on its own, is configured to detect a rinsing session by calculation of movement and absence of stroke events. The stroke sensor may include and/or otherwise be coupled to an accelerometer, a gyroscope, a temperature sensor, a proximity sensor, and/or one or more additional sensors.

Although not shown, system 10 may include one or more additional sensors to help detect information that may be indicative of rinsing shaver 12. For example, one or more of shaver 12 or the mount or docking station (not shown) may include proximity, optical, RFID, or other sensors to detect when shaver 12 is uncoupled from the mount or docking station. In these aspects, and as discussed in detail below, system 10 is configured to detect water consumption during rinsing shaver head 34 and also overall or total water consumption during a shaving session.

Processor 18 may be in communication with microphone 14 and accelerometer 16. Processor 18 may receive signals from microphone 14 and accelerometer 16, and may apply one or more analyses to the received signals, for example, computer logics 20, 22. For example, processor 18 may compare the received signals to stored signal thresholds and/or other parameters, for example, from a memory or storage device (not shown). In examples, processor 18 may be coupled to another memory or storage device (not shown) to communicate and store information, e.g., volumetric measurements, totals, etc. regarding water consumed during a shaving session, water consumed during a rinsing session, water consumed during a plurality of shaving sessions, water consumed during a plurality of rinsing sessions, etc.

First computer logic 20 may be configured to detect when water 100 is being delivered from the faucet, other water source, etc. For example, computer logic 20 may receive signals from one or more sensors, e.g., microphone 14, to detect the sound from water 100 being delivered from the faucet, other water source, etc. Computer logic 20 may include recognizing sounds, volumes, intensities, tones, pitches, etc. via microphone 14 that are indicative of the flow of water 100 from the faucet or other water source, and in some cases that are indicative of the flow of water from the faucet or other water source, without and/or without simultaneous flow on, over, or through shaver head 34. In examples, computer logic 20 may recognize sounds, volumes, intensities, tones, pitches, etc. via microphone 14 that are indicative and can be correlated to a volumetric flow rate of water 100. For example, a louder sound, and/or a combination of other factors mentioned above, e.g. sound, volume, intensity, tone, pitch, etc., may be indicative of a greater volumetric flow of water 100. First computer logic 20 may be configured to initiate a calculation mode upon detecting the flow of water, and the calculation mode may include continuously monitoring one or more sensors, e.g., microphone 14, to calculate a total volume of water 100 delivered during the shaving session. For example, first computer logic 20 may detect instantaneous volumetric flow rates over the duration of the shaving session and may also record the duration of the shaving session, for example, by detecting when the flow of water 100 has ended from a faucet or other water source. An average of the instantaneous volumetric flow rate multiplied by the total duration of the shaving session may yield the total amount of water 100 delivered during the shaving session.

Second computer logic 22 may be configured to detect when water 100 is being delivered from the faucet, other water source, etc. and on a portion of shaver 12, for example, on, over, or through shaver head 34 in a rinsing session. For example, computer logic 22 may receive signals from one or more sensors, e.g., microphone 14, to detect the sound from water 100 being delivered from the faucet, etc. and over shaver 12. Computer logic 22 may include recognizing sounds, volumes, intensities, tones, pitches, etc. via microphone 14 that are indicative of the flow of water 100 from the faucet, etc. and on, over, or through shaver head 34. In examples, computer logic 22 may receive signals from one or more sensors, e.g., accelerometer 16, to detect that shaver 12 is in a rinsing position, for example, in a substantially horizontal orientation and/or not moving. In examples, second computer logic 22 may receive signals from additional sensors, for example, the stroke sensor. For example, the stroke sensor may detect when shaver 12 is not performing a stroke or has not performed a stroke after elapse of a certain amount of time, which, alone or in combination with a substantially horizontal orientation, is indicative of a rinsing session. For example, computer logic 22 may be configured to detect a rinsing session when accelerometer 16 signals a rinsing position and when the stroke sensor indicates that a stroke is not being performed.

Computer logic 22 may recognize sounds, volumes, intensities, tones, pitches, etc. via microphone 14 that are indicative and can be correlated to a volumetric flow rate of water 100 over shaver 12. For example, a louder sound may be indicative of a greater volumetric flow of water 100 over shaver. Second computer logic 22 may be configured to initiate a calculation mode upon detecting the flow of water over shaver 12 and that shaver 12 is in a rinsing position, and the calculation mode may include continuously monitoring one or more sensors, e.g., microphone 14 and accelerometer 16, to calculate a total volume of water 100 delivered during the rinsing session. For example, second computer logic 22 may detect instantaneous volumetric flow rates over the duration of the rinsing session. Second computer logic 22 may also record the duration of the rinsing session for example, by detecting when the flow of water 100 over shaver 12 has ended and/or when shaver 12 is no longer in the rinsing position. An average of the instantaneous volumetric flow rate multiplied by the total duration of the rinsing session may yield the total amount of water 100 delivered during the rinsing session.

Second computer logic 22 may be dependent on first computer logic 20. In examples, second computer logic 22 may be independent and/or not restricted by first computer logic 20. For example, in one aspect, processor 18 may only perform second computer logic 22 once first computer logic 20 has been performed and indicates that water is flowing. In aspects, processor 18 may only determine whether water is flowing on, over, or through shaver head 34 after processor 18 has determined that water is flowing from a faucet, other water source, etc. This may help economize and/or streamline the processing capabilities of processor 18. In aspects, the calculated duration of the rinsing session may be a portion of the calculated duration of the shaving session, and the calculated amount of water used during the rinsing session may be a portion of the calculated amount of water used during the shaving session.

In examples, it is contemplated that first computer logic 20 and second computer logic 22 may operate simultaneously, and that second computer logic 22 may be dependent on values from first computer logic 20, and vice versa. For example, during rinsing of shaver 12, microphone 14 may be receiving: 1) sounds attributable to the mere running of water from the faucet or other water source, and/or 2) sounds attributable for rinsing. In examples, first computer logic 20 and second computer logic 22 may be configured to filter or otherwise ignore sounds that do not contribute to their intended calculations, or may be calibrated to adjust for the presence of such sounds that to not contribute to their intended calculations, i.e., "noise". First computer logic 20 and second computer logic 22 may be dependent on one another. For example, the values calculated by first computer logic 20 may be constrained by values calculated by second computer logic 22 and vice versa. The amount of running water should always be equal to or higher than the amount of water used in rinsing.

In examples, second computer logic 22 may be independent of first computer logic 20. In aspects, processor 18 may determine that water is flowing on, over, or through shaver head 34 even if processor 18 has not yet determined that water is flowing from a faucet, etc. This may help to ensure that a duration of a rinsing session is measured in an instance where there was an error, e.g., interference, insufficient sensor data, etc., in first computer logic 20.

It is noted that computer logics 20, 22 may each include one or more artificial neural networks. The neural networks may have been trained (or may be trained) to recognize when water is flowing and/or when shaver 12 is being rinsed, for example, based on the networks' connections to one or more sensors on shaver 12 or other components of system 10. For example, a first neural network may be configured to detect water flowing and determine a duration of the water flow, e.g., via microphone 14 or one or more other sensors, and a second neural network may be configured to detect an orientation of shaver 12, e.g., via accelerometer 16 or one or more other sensors. In examples, accelerometer 16 and the second neural network may detect patterns of movement over time that are indicative of rinsing, e.g., tapping the shaver against a hard object, quick repeated flicking of the shaver, slight rotations of the shaver, and the like, which may be used to determine, adjust, calibrate, or modify the determined rinsing time and/or water usage during rinsing. The neural networks may continually train and learn as more data is collected by an individual user, and by any user worldwide sending data to a common server.

In examples, computer logics 20, 22 may be stored in or on a mount or docking station (not shown) for shaver 12, a cloud-based server (not shown), an application on mobile device 26, smart home system 28, smart automobile 30, or otherwise in communication with system 10. Although microphone 14 is discussed as being on shaver 12, this disclosure is not so limited. For example, although not shown, microphone 14 (or another microphone) may be on a mount or docking station or otherwise positioned in the vicinity of shaver 12.

Communication unit 24 may communicate with processor 18 and one or more remote devices, as mentioned above. For example, communication unit 20 may include a wireless or wired internet connection to send and/or receive electronic information. Communication unit 24 may also include a transmitter and/or receiver to exchange electronic information with one or more remote devices, for example, a Bluetooth™, AirDrop™, wireless internet e.g., Wi-Fi, or any other suitable connection now known or that may be similarly developed in the future. For example, communication unit 24 may communicate the total water usage for a shaving session and/or the total water usage for a rinsing session to mobile device 26. The respective water usages may be numerically displayed to the user, may be graphically displayed to the user, may be displayed to the user as a portion of the overall water and/or energy consumption for the user and/or the user's household, etc.

Figure 2:
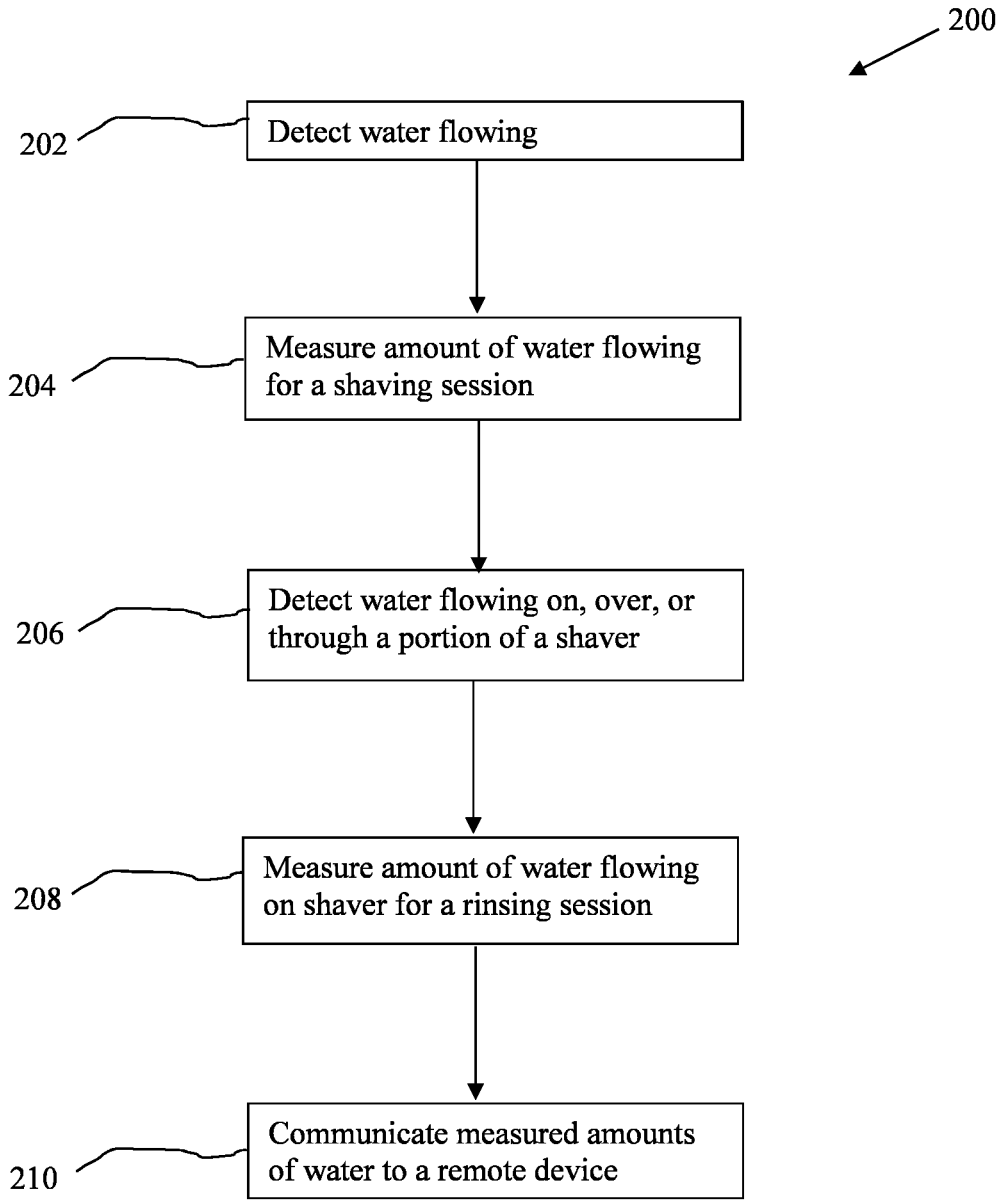
FIG. 2 is a flow diagram of a method for measuring and/or monitoring water usage and/or rinsing of a shaver, according to aspects of the present disclosure.

FIG. 2 is a flowchart illustrating a method 200 of measuring water usage for a shaving device, according to aspects of the present disclosure. For example, method 200 includes a step 202 that includes detecting water flow. As discussed above, step 202 may include microphone 14 detecting sound levels indicative of water 100 flowing from a faucet or other water source.

In examples, method 200 includes a step 204 that includes measuring an amount of water flowing for a shaving session. As discussed above, step 204 may include microphone 14 detecting sound levels that are indicative of the amount of water 100 flowing from the faucet or other water source. Step 204 may also include detecting a duration of the water flow, for example, a time from the initiation of the water flow to an end of the water flow. As discussed above, first computer logic 20 may be used to calculate the amount of water flowing, for example, from the faucet, other water source, etc. Step 204 may require filtering of sounds attributable to rinsing events as further described below with respect to steps 206 and 208. In examples, the values calculated at step 204 may selectively filter or drop values received during rinsing. For example, rinsing sounds may be loud enough to interfere with the detection of running water sounds. In such examples, first computer logic 20, may use calculated values from before and after detection of rinsing events, at steps 206 and 208, to infer the amount of water that flowed from a faucet or other water source. First computer logic 20 may at least use the values from before and after rinsing events to inform or modify values calculated during rinsing. For example, in some cases, a user does not adjust water flow while rinsing, and thus, first computer logic 20 may assume or otherwise infer that the same water flow was used during rinsing steps as the constant water flow calculated before and after rinsing. In examples, a user does adjust the water flow while rinsing the shaver 12 (up or down), and first computer logic 20 may use calculated water flow values from before and after rinsing events, to modify calculated values and/or improve interpretation of various sounds recorded during rinsing thereby improving the accuracy of the calculations.

Method 200 may also include a step 206 that includes detecting water flow on a portion of a shaver, for example, on, over, or through shaver head 34. Step 206 may include microphone 14 detecting sound levels indicative of water flowing on, over, or through shaver head 34. Alternatively or additionally, step 206 may include accelerometer 16 detecting that shaver 12 is in a rinsing position, for example, a substantially horizontal orientation and/or not moving. In examples, step 306 may include receiving signals from additional sensors, for example, the stroke sensor. For example, the stroke sensor may detect when shaver 12 is not performing a stroke or has not performed a stroke after elapse of a certain amount of time, which, alone or in combination with a substantially horizontal orientation, is indicative of a rinsing session. For example, step 206 may include detecting a rinsing session when accelerometer 16 signals a rinsing position and when the stroke sensor indicates that a stroke is not being performed.

In examples, a step 208 includes measuring an amount of water flowing on the shaver for a rinsing session, for example, on, over, or through shaver head 34. As discussed above, step 208 may include microphone 14 detecting sound levels that are indicative of the amount of water flowing on, over, or through shaver head 34. Step 208 may also include detecting a duration of the water flow, for example, a time from the initiation of the water flow to an end of the water flow and/or or a time from shaver 12 being in the rinsing position to a time when shaver 12 is no longer in the rinsing position. As discussed above, second computer logic 22 may be used to calculate the amount of water flowing on, over, or through the portion of shaver 12.

Method 200 may also include a step 210 that includes communicating the measured amounts of water to a remote device. For example, processor 18, via communication unit 24, may transmit the measured amounts of water 100 to mobile device 26, smart home system 28, and/or smart automobile 30.

Although not shown, method 200 may include an initiation step, which may include shaver 12 being separated and/or removed from a mount or docking station, one or more sensors on shaver 12 detecting movement, etc. This initiation step may activate microphone 14, accelerometer 16, processor 18, etc.

In aspects, step 210 may be avoided. For example, rather than communicating the measured amounts of water to a remote device, shaver 12 or another component of system 10 may store the measured amounts of water.

System 10 may display the measured water usage. For example, system 10 may displayed the measured water usage and/or rinsing performance, among other data, on mobile device 26, e.g., via an application for shaver 12, smart home 28, automobile 30, etc. Additionally or alternatively, system 10 may display the measured water usage and/or rinsing performance, among other data, on a display (not shown) on shaver 12 or a mount or docking station.

System 10 may display the amount of water used in a shaving session. For example, system 10 may monitor and/or display the amount of water, for example, in a volumetric measurement (e.g., in milliliters) or in a time (e.g., in seconds) that the faucet is on, for an individual shaving session. System 10 may also help the user to ensure that the faucet or other water source is not left running longer than necessary, using unnecessary water, etc. In examples, system may compile the amount of water used over a number of shaving sessions. In aspects, system 10 may indicate to the user the total water used over a number of shaving sessions, an average amount of water used during a shaving session, etc.

In examples, system 10 may display the amount of water used to rinse shaver head 34 in a rinsing session. For example, system 10 may monitor and/or display the amount of water, for example, in a volumetric measurement (e.g., in milliliters) or in a time (e.g., in seconds) that the faucet is on, for an individual rinsing session. For example, system 10 may help the user to ensure that shaver head 34 has been adequately rinsed during a rinsing session, which may help provide an efficient and/or comfortable shave. System 10 may also help the user to ensure that shaver head 34 has not been overly rinsed during the rinsing session, which may shorten the lifetime of shaver head 34, uses unnecessary water, etc. In examples, system may compile the amount of water used to rinse a single shaver head 34, for example, over a number of shaving sessions. In this aspect, system 10 may indicate to the user the total water used to rinse shaver head 34, which may be used to, for example, indicate to the user that it is time to replace shaver head 34, replace shaver 12, etc.

In examples, the measured amounts of water may be accumulated with previously measured amounts of water, for example, to calculate and/or provide total amounts of water used during a number of shaving sessions and/or during rinsing sessions. The total amounts of water used during shaving sessions and/or during rinsing sessions may be calculated daily, weekly, monthly, yearly, etc. The total amounts of water may be compared to previously calculated amounts of water, e.g., one or more previous weeks, months, years, etc. or to target amounts of water, e.g., recommend total amount of water used for a shaving session, a week's worth of shaving sessions, a month's worth of shaving sessions, a year's worth of shaving sessions, etc.

In examples, although not shown, the total amounts of water may be reset, for example, via a button on shaver 12 or via a user interface, e.g., on mobile device 26. In examples, a user may reset the total water used during rinsing sessions when the user replaces shaver head 34. For example, if system 10 indicates to the user that it is time to replace shaver head 34, the user may do so and then reset the rinsing time calculations. Alternatively or additionally, the reset may be automatically conducted by shaver 12, when shaver 12 is equipped to automatically determine that the user has replaced shaver head 34.

System 10 may help the user to use appropriate amounts of water. For example, if system 10 detects that water is flowing after a rinsing session has ended, i.e., the user is continuing to shave but left water running from the faucet, other water source, etc., system 10 may provide an alert to the user. The alert may suggest that the user turn off the faucet or other water source. The alert may be an audible alert, for example, from a speaker on shaver 12, may be a visible alert, e.g., a flashing light or notification, displayed on mobile device 26 or another component of system 10, or may otherwise alert the user. In examples, in a similar manner, the system 10 may alert the user that a rinsing session is complete based on, for example, a sufficient amount of water being passed through shaver 12 and/or by recognizing subtle changes in volume, pitch, tone, intensity, or the like, when shaver 12 is adequately rinsed. In these aspects, system 10 may help to reduce the total amount of water used during a shaving session.

In examples, the total water usage may be displayed relative to the water consumption of the user, e.g., household water usage. In aspects, the system 10 may help the user to reduce the overall water consumption during shaving and rinsing, thus reducing the overall water household water usage. Displaying these water usage amounts may help to encourage the user to reduce the overall water usage by increasing the user's awareness of the environmental impacts of the shaving and rinsing sessions, the impacts of the shaving and rinsing sessions on the user's utility bill, etc. The data calculated herein can be linked through APIs to other computer logic that gives advice on home energy consumption. Shaver systems according to the present disclosure thus can become integral parts of a Smart Home Network.

In embodiments, a mobile application associated with shaver 12 may be used to provide various alerts and/or recommendations to the user. The alerts and/or recommendations may be sent at any suitable time, but may in particular be sent before, during, and/or after a specific shaving session. For example, an alert and/or recommendation may be sent, based on a user's prior history of water usage/rinsing, to improve water usage efficiency of rinsing. In particular, an alert and/or recommendation may suggest an action to improve water usage/rinsing efficacy, e.g., a recommendation to turn off a faucet during or after shaving, a recommendation to rinse the shaver head thoroughly, for a certain amount of time, a recommendation to reduce the amount of time that a shaver is rinsed. Similar alerts or recommendations may be sent during shaving and/or rinsing to a user device and/or to the shaver itself. In examples, the alerts and/or recommendations also may be presented immediately after shaving, either to reinforce good outcomes, or help a user identify poor rinsing performance/wasteful water usage. In embodiments, the system may provide data indicating the number of strokes carried out by the user since the last rinsing and/or the wear condition of the blades and/or the clogging condition between the blades, etc. The system may be configured to provide real-time shaving data. In embodiments, shaving information/data may comprise at least one real time signal relating to one or more of increasing/decreasing water temperature, increasing/decreasing water flow, increasing/decreasing shaver rinsing frequency, increasing/decreasing shaver rinsing duration occurrence and replacing the shaver/shaver cartridge.

For example, if the water is too cold, providing hotter water may help improving rinsing efficiency and reducing water consumption. For example, if the water is too hot, providing colder water may help saving hot water while keeping the same level of rinsing efficiency. For example, adjusting the water flow to the flow adapted to a standard shaver or to the exact design of the shaver 12 may help reduce water consumption. For example, if the user performs too many shaving strokes before rinsing, reducing the number of strokes between two successive rinses may improve the rinsing efficiency and save water. This data may be provided by the shaver 12, or historical data can be provided based on previously-collected data if a standard shaver is used. For example, if the user performs too few shaving strokes before rinsing, increasing the number of strokes between two successive rinses may lead to an optimal rinsing performance. Improving rinsing may also provide better shaving performance/skin care. In embodiments, based on historical rinsing performance and historical shaver usage, the system may suggest different shaver types, shaver head types, or the like, that may be compatible with the user and/or that may improve performance. In examples, the user may select one of more available shaver/shaver head models, and the system may provide predictions as to how the selected shaver/shaver head models will perform when based on the user's historical performance and preferences.

The shaver rinsing frequency may correspond to the elapsed time between two rinsing occurrences or may correspond to the number of shaving strokes carried out between two rinsing occurrences. The number of shaving strokes may be counted using any suitable mechanism, including, for example, data from accelerometer 16. The replacement of the shaver/shaver cartridge may correspond to a signal indicating that the shaver/shaver cartridge is worn and needs to be replaced by a new one to improve shaving (and rinsing) efficiency or may correspond to a signal indicating that another type of shaver, for example having a specific geometry design, better adapted to the user habits and thus more efficient for the user habits, for example rinsing habits, should be used.

In embodiments, a method for assisting shaving comprising a first step of measuring rinse water flow and/or measuring rinse water temperature and/or detecting a shaver rinsing occurrence and a second step of providing shaving information on the basis of the data collected during the first step, is contemplated.

The method may be carried out irrespective of the way the user rinses the shaver, i.e., using a continuous flow of water during shaving or an intermittent flow of water flowing during rising episodes only. A user may control the faucet, other water source, etc. to deliver water only during the rinsing episodes while shaving information may assist the user to reduce water consumption during such episodes. Another user may let water continuously flow during shaving, while shaving information may assist that user in order to reduce total water consumption and/or provide advice to the user to more cautiously use water during the shaving routine (e.g., using an intermittent flow of water flowing during rising episodes only).

In embodiments, the steps may be performed in real time during shaving.

Unless specifically stated otherwise, as apparent from the following discussions, it is appreciated that throughout the specification discussions utilizing terms such as "processing," "computing," "calculating," "determining," "analyzing" or the like, refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory.

In accordance with various implementations of the present disclosure, the methods described herein may be implemented by software programs executable by a computer system. Further, in an exemplary, non-limited implementation, implementations can include distributed processing, component/object distributed processing, and parallel processing. Alternatively, virtual computer system processing can be constructed to implement one or more of the methods or functionalities as described herein.

Although the present specification describes components and functions that may be implemented in particular implementations with reference to particular standards and protocols, the disclosure is not limited to such standards and protocols. For example, standards for Internet and other packet switched network transmission (e.g., TCP/IP, UDP/IP, HTML, HTTP) represent examples of the state of the art. Such standards are periodically superseded by faster or more efficient equivalents having essentially the same functions. Accordingly, replacement standards and protocols having the same or similar functions as those disclosed herein are considered equivalents thereof.

It will be understood that the steps of methods discussed are performed in one embodiment by an appropriate processor (or processors) of a processing (i.e., computer) system executing instructions (computer-readable code) stored in storage. It will also be understood that the disclosure is not limited to any particular implementation or programming technique and that the disclosure may be implemented using any appropriate techniques for implementing the functionality described herein. The disclosure is not limited to any particular programming language or operating system.

It should be appreciated that in the above description of exemplary embodiments, various features are sometimes grouped together in a single embodiment, figure, or description thereof for the purpose of streamlining the disclosure and aiding in the understanding of one or more of the various aspects. This method of disclosure, however, is not to be interpreted as reflecting an intention that the claims require more features than are expressly recited in each claim. Rather, as the following claims reflect, the different aspects lie in less than all features of a single foregoing disclosed embodiment. Thus, the claims following the Detailed Description are hereby expressly incorporated into this Detailed Description, with each claim standing on its own as a separate embodiment.

Furthermore, while some embodiments described herein include some but not other features included in other embodiments, combinations of features of different embodiments are meant to be within the scope of the disclosure, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the disclosure.

In the description provided herein, numerous specific details are set forth. However, it is understood that embodiments may be practiced without these specific details. In other instances, well-known methods, structures, and techniques have not been shown in detail in order not to obscure an understanding of this description.

While there has been described what are believed to be the embodiments, those skilled in the art will recognize that other and further modifications may be made thereto and it is intended to claim all such changes and modifications as falling within the scope of the disclosure. For example, any formulas given above are merely representative of procedures that may be used. Functionality may be added or deleted from the block diagrams and operations may be interchanged among functional blocks. Steps may be added or deleted to methods described.

The above disclosed subject matter is to be considered illustrative, and not restrictive, and the appended claims are intended to cover all such modifications, enhancements, and other implementations, which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description. While various implementations of the disclosure have been described, it will be apparent to those of ordinary skill in the art that many more implementations and implementations are possible within the scope of the disclosure. Accordingly, the disclosure is not to be restricted except in light of the attached claims and their equivalents.

What is claimed is:

1. A shaving system comprising:

a shaver including a shaver head;

one or more sensors configured to detect a flow or sound of water or an orientation of the shaver; and a processor configured to determine a duration and/or water usage during a shaving session and/or a rinsing session;

wherein the processor includes an algorithm configured to collect data from the one or more sensors and provide accuracy metrics of water usage and provide relevant advice to a user.

2. The system of claim 1, further comprising a remote device configured to display one or more of the duration and/or the water usage for the shaving session and/or the rinsing session.

3. The system of claim 2, wherein the one or more sensors includes a microphone on or within the shaver and/or on or within the remote device.

4. The system of claim 1, wherein the one or more sensors includes an accelerometer on or within the shaver.

5. The system of claim 1, wherein the one or more sensors includes a stroke sensor on or within the shaver.

6. The system of claim 1, wherein the one or more sensors includes an orientation sensor on or within the shaver.

7. The system of claim 3, wherein the processor is configured to determine the duration and/or the water usage of the shaving session by analyzing one or more signals from the microphone.

8. The system of claim 3, wherein the processor is configured to determine the duration and/or the water usage of the rinsing session by analyzing one or more signals from the microphone and/or one or more signals from an accelerometer and one or more signals from a stroke sensor.

9. The system of claim 3, wherein the processor is configured to measure a total duration and/or total amount of water used during a plurality of rinsing sessions for the shaver.

10. The system of claim 3, further comprising an alarm configured to be activated if signals from the microphone are received during a predefined amount of time.

11. A computer-implemented method of analyzing a shaving session, the method comprising:

receiving one or more signals from a microphone that are indicative of water flowing, wherein the microphone is coupled to a shaver, and/or to a dock for the shaver;

analyzing the one or more signals from the microphone to determine an amount of water used for a shaving session;

receiving one or more signals from the microphone, an accelerometer, and/or a stroke sensor that are indicative of water flowing over a portion of a shaver, wherein the accelerometer is coupled to the shaver; and analyzing the one or more signals from the microphone and the accelerometer and/or the stroke sensor to determine a duration and/or an amount of water used for a rinsing session.

12. The computer-implemented method of claim 11, further comprising communicating one or more of the duration and/or amount of water used for the shaving session or the duration and/or amount of water used for the rinsing session to a remote device.

13. The computer-implemented method of claim 11, further comprising predefining an amount of time in which signals from the microphone and/or accelerometer and/or stroke sensor are received before activating an alarm.

14. The computer-implemented method of claim 11, further comprising determining a value or index of water consumption of a shaving session based on the signals from the microphone and/or the accelerometer and/or the stroke sensor.

15. The computer-implemented method of claim 11, further comprising providing personalized shaving advice to a user on shaving razor and/or head choice and/or shaving techniques, in order to improve water consumption.

16. The system of claim 4, further comprising an alarm configured to be activated if signals from the accelerometer are received during a predefined amount of time.

17. The system of claim 5, further comprising an alarm configured to be activated if signals from the stroke sensor are received during a predefined amount of time.

18. The system of claim 1, wherein the algorithm is configured to be trained during use of the system thereby becoming accustomed to user's individual shaving style and needs.

19. The system of claim 1, wherein the processor include one or more computer logics, the computer logics including one or more artificial neural networks configured to be trained to recognize when water is flowing and/or when the shaver is being rinsed.

20. A shaving system comprising:

a shaver including a shaver head;

one or more sensors configured to detect a flow or sound of water or an orientation of the shaver; and a processor configured to determine a duration and/or water usage during a shaving session and/or a rinsing session;

wherein the one or more sensors includes a microphone on or within the shaver and/or on or within a remote device.

* * * * *